US005896706A

United States Patent [19]

Pike

[11] Patent Number: 5,896,706

[45] Date of Patent: Apr. 27, 1999

[54] ROTATING RAIN GUTTER AND BRACKET SYSTEM

[76] Inventor: Clayton D. Pike, 7430 Grand Terrace Ct., Houston, Tex. 77095-4464

[21] Appl. No.: 08/824,806

[22] Filed: Mar. 26, 1997

[51] Int. Cl.[6] ..... E04D 13/072

[52] U.S. Cl. ..... 52/11

[58] Field of Search ..... 52/11

[56] References Cited

U.S. PATENT DOCUMENTS

| | | | |
|---|---|---|---|
| 538,108 | 4/1895 | Freeze . | |
| 4,072,285 | 2/1978 | Greenwood . | |
| 4,117,635 | 10/1978 | Nelson . | |
| 4,119,008 | 10/1978 | Ward | 52/11 X |
| 4,411,108 | 10/1983 | Kerester . | |
| 4,696,131 | 9/1987 | Schreffler . | |
| 4,807,406 | 2/1989 | Densmore . | |
| 4,837,987 | 6/1989 | Fender . | |
| 5,184,435 | 2/1993 | Sherman . | |
| 5,197,237 | 3/1993 | Owens . | |
| 5,274,965 | 1/1994 | Jackson . | |
| 5,417,015 | 5/1995 | Coyne . | |
| 5,526,611 | 6/1996 | Leahy | 52/11 |
| 5,548,931 | 8/1996 | Bryant | 52/11 |

*Primary Examiner*—Christopher Kent
*Attorney, Agent, or Firm*—Baker & Botts, L.L.P.

[57] ABSTRACT

A simplified rotating gutter and bracket system wherein the arcuate gutter is reinforced along its length with multiple stabilizing rings that increase torsional strength. At least some of the stabilizing rings of the gutter are provided with protrusions called engagers. The engagers are placed relatively high on the gutter/stabilizing ring annulus, thus allowing a maximum degree of rotation before the user becomes hampered by the close proximity of a building.

The bracket contains an arcuate portion adapted to receive a gutter of slightly smaller diameter. The arcuate portion of the bracket is attached to the house or building via an attachment portion and house fasteners. Preferably, the bracket is fitted over a stabilizing ring. The arcuate portion of the bracket may also be provided with a slot therein, through which the engager will protrude when the gutter is assembled with the bracket.

The gutter is rotated within the bracket with the aid of a pole hook used to apply force to the gutter via the engager. The gutter may be rotated a full 180°, but is prevented from disengaging from the bracket because the arcuate portion is of sufficient arc to hold the gutter.

17 Claims, 3 Drawing Sheets

FIG.2c
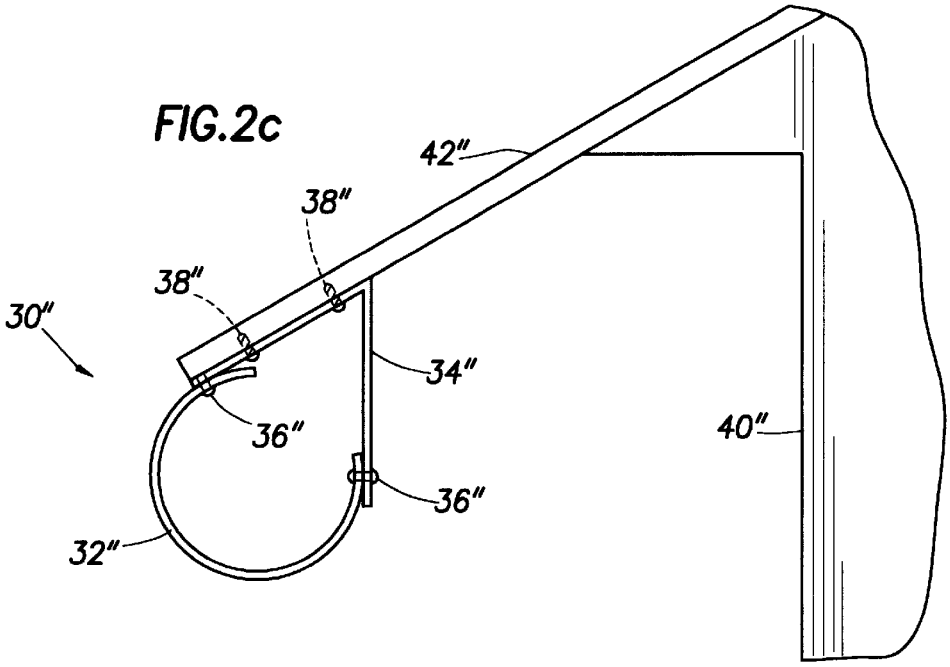
FIG.3
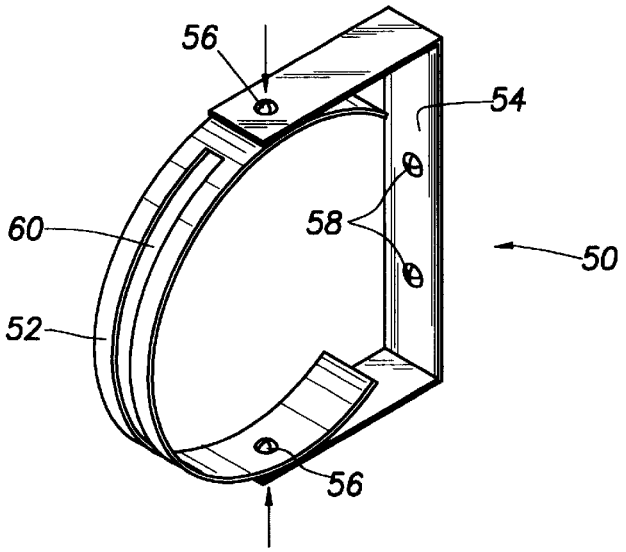
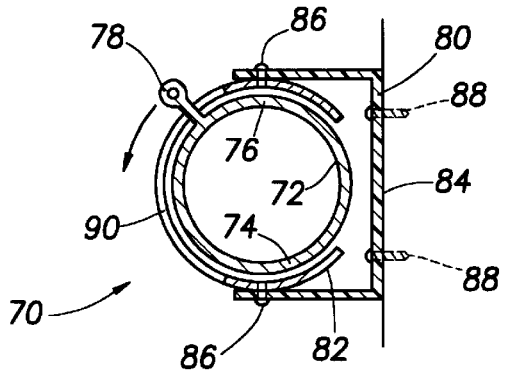
FIG.4

FIG.5a
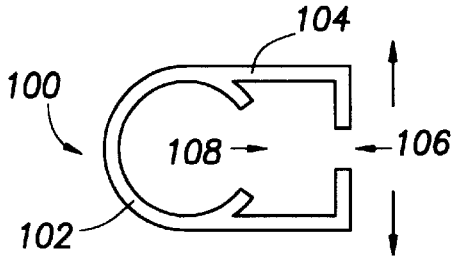
FIG.5b
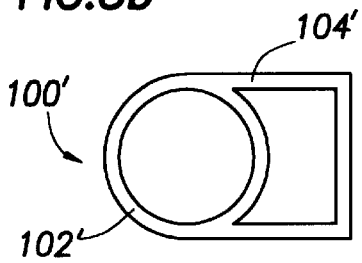
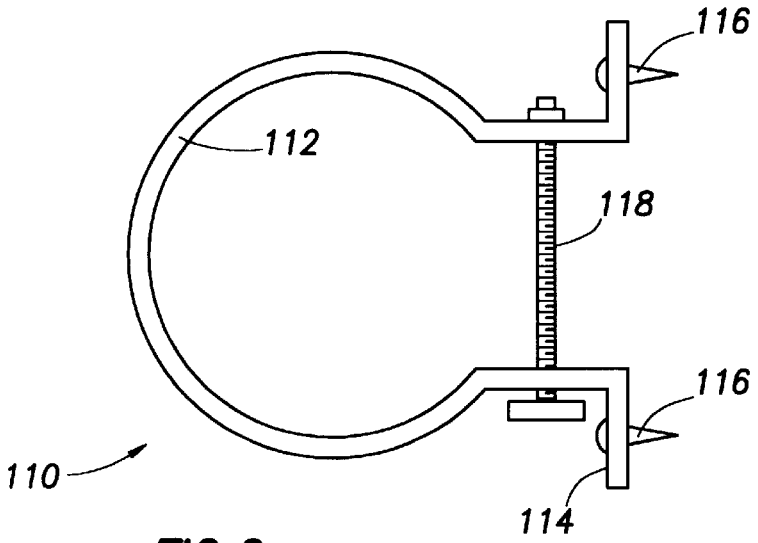
FIG.6
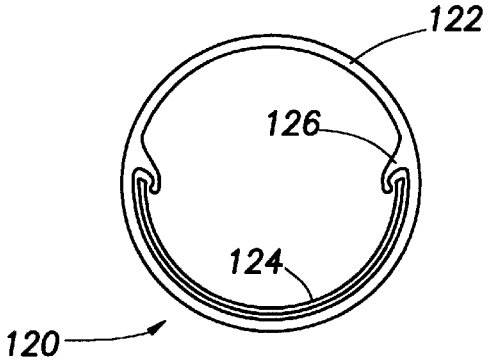
FIG.7
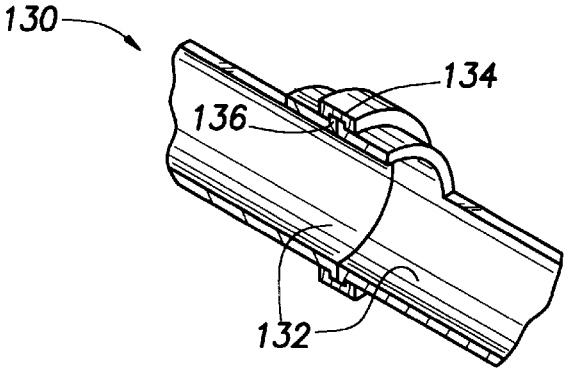
FIG.8

ROTATING RAIN GUTTER AND BRACKET SYSTEM

BACKGROUND OF THE INVENTION

1. Field of the Invention

This invention relates to a rotating rain gutter and bracket system that can be easily cleaned of accumulated debris by rotating the gutter.

2. Description of the Prior Art

A well-known problem with rain gutters is that they also collect all the debris that falls on a roof. Left unattended, rain gutters will quickly clog up with leaves and twigs, thus hampering their effectiveness. Hence, it is necessary to regularly clean a rain gutter for maximum performance. Additionally, children often lodge balls and other toys in gutters and need some easy, go a safe mechanism for dislodging toys.

One method of cleaning a rain gutter is to turn it over so that the debris will fall out. Several rotating rain gutter systems have been devised and can be classified in three basic categories. First, there are those gutter systems that rotate a gutter about a point close to the house attachment point (see, e.g., U.S. Pat. Nos. 4,072,285; 5,417,015). Second, there are gutter systems that rotate about a point farthest removed from the house (see, e.g., U.S. Pat. Nos. 538,108; 4,696,131; 4,837,987; 5,184,435; 5,274,965). Thirdly, there are those gutter systems that rotate at a point in between—that is, they rotate about the central horizontal axis of the gutter itself.

Gutters of this third type have been described. For example, U.S. Pat. No. 4,117,635 by Nelson describes a bracket and pulley system that holds a gutter. The gutter is placed inside a disc which is connected to the pulley system. The disc is held inside a bracket mounted to the fascia of a house and allowed to rotate freely therein. When the pulleys are activated, they rotate the disc, thus rotating the gutter held thereby. This system is disadvantaged by the complicated nature of the bracket and pulley system. Complex parts are more difficult and expensive to manufacture, install and maintain. Further, there is no means of preventing the disc, and thus the gutter, from disassembling itself from the rest of the system should the gutter be banged from underneath or vigorously over-rotated. Also, the gutter may only be rotated from the point where the pulley is attached.

U.S. Pat. No. 4,411,108 by Kerester describes a gutter and bracket system where the gutter is held by arcuate brackets attached to the fascia of a house. An arcuate (semi-cylindrical) gutter rests inside the bracket on roller bearings. The gutter is rotated from one end via a pulley system. This gutter system solves the problem of dislodging the gutter accidentally from the bracket by contemplating a bracket of sufficient arc to prevent the gutter from being dislodged. For example, a bracket with a 270° arc will not allow a 180° arc gutter to fall out of it, even if rotated a full 360°. However, there is no means of torsionally stabilizing the gutter, which will tend to twist when rotated from one end, particularly as the bearings degrade and as the weight of the gutter increases with debris and increased length. Further, the device again employs a complicated pulley and bracket system. The use of roller bearings is expensive and subject to degradation as the system is exposed to dirt and water. Also, the gutter may only be rotated from the end point where the pulley is attached.

U.S. Pat. No. 5,197,237 by Owens describes a gutter system that attaches to the overhang of a roof. The bracket is J-shaped and thus open on top. A small lip is provided to prevent the gutter from being knocked free of the bracket, but it is possible to flex the bracket and dislodge the gutter. A semi-disc-shaped adapter with an outside edge adapted to fit the arcuate J-shaped bracket and an inside edge adapted to hold a standard gutter is provided. This adapter functions as the interface between the J-shaped bracket and gutters of standard design. A small loop is provided on the adapter at a point near the bottom-most part of the adapter for turning the gutter. An end-cap and down spout are also provided for conducting rainwater down off the house. In order to clean this gutter, the user must first disconnect the end cap, then reach for the loop with a long pole hook, apply force to the loop and turn the gutter. This system is disadvantaged because the loops are located 15–30° from the bottom-most point of the gutter. Thus, the user will not have much rotational freedom before being obstructed by the wall of the house. In fact, the gutter of this invention may only be rotated 90°, rather than a full 180°. Furthermore, it is still possible to dislodge the gutter from the bracket and there is no means of providing torsional stability to the gutter.

These and other disadvantages of the prior art are overcome by the present invention, and an improved rotating rain gutter and bracket is provided.

SUMMARY OF THE INVENTION

A gutter that can be inverted has long been desirable for ease of cleaning the gutter of accumulated debris. However, the prior art gutters have been complicated, expensive devices, subject to torsional stresses, difficult to rotate and/or capable of being separated from their holding brackets. The invention described herein surmounts these disadvantages.

Generally speaking, the invention is an improved, yet simplified, rotating rain gutter and bracket system with increased resistance to torsional stress. Because the gutter is strengthened with respect to torsional strain, it can be rotated by a force applied directly to the gutter, rather than the bracket. This allows for a simplified, less expensive bracket. The use of pulleys, levers and complicated brackets is therefore eliminated, although automatic rotational drives may be employed if desired. Furthermore, the gutter may be rotated at any of several points along its length, facilitating its cleaning even though obstacles may prevent easy access at some points along the gutter length.

The gutter itself has a trough for catching building runoff, a plurality of stabilizing rings connected to said trough at intervals for increased resistance to torsional strain and one or more engagers protruding from said stabilizing rings which are used to rotate the gutter. The intervals at which the stabilizing rings are placed is determined by the strength and flexibility of the material used to form the gutter, but in general an interval of 1 to 10 feet is suitable, and an interval of 2–5 feet, for example, is preferred when plastic of 5 mm thickness is employed.

When forming the gutter of a moldable or cuttable material, it may be preferred to form the stabilizers integral with the trough. Alternatively, the stabilizer can be separate from the trough and designed to fit closely around the it. This design may be preferred when the trough is formed from sheet metal. In this embodiment, the sheet metal can be cut to the desired length on site and fitted into standard stabilizer rings. This embodiment allows for ease of manufacture and transport of components. Optionally, the inside surface of the stabilizer ring can be shaped to fit existing box-shaped troughs, thus converting existing troughs into rotating troughs. In this embodiment, it is necessary that the stabilizer ring be assembled inside the arcuate portion of the bracket for easy rotation of the trough.

Where the stabilizer ring and trough are not integral, fasteners or adhesives could be used to attach the two. Alternatively, the attachment could be frictional, employing ridges or a rough surface to fix the gutter within the ring. Another possibility is that the stabilizer ring could be shaped with a small protrusion or groove on its inner surface to receive and hold the ends of the sheet metal.

The engagers may, but need not be, placed on each stabilizing ring. A balance between aesthetics and easy access to an engaging means when confronted with shrubbery and other obstacles will determine the optimum placement of engagers. The engager may be attached to a stabilizer ring by screwing an eye loop or similar device into the ring. Alternatively, the engager may be integrally formed with the gutter. Any shape of engager that allows easy capture with a pole hook will function in this regard, including a T-shaped protrusion, an eye loop or a hook. Alternatively, a rope or cable may depend from the engager.

The positioning of the engager on the stabilizer ring, rather than on the trough, allows for more rotational freedom before the user is hampered by the close proximity of a building. With a bent stem on an engager, it is possible to place the engager quite high on the stabilizer ring yet still allow the user to reach the engager with a long pole hook. A position between 0° and 45° is preferred (0° corresponding to the top of the stabilizer ring). With the high placement of the engager, the gutter can be rotated a full 180° if desired.

The stabilizer rings provide increased resistance to torsional stress. Therefore, when a force is applied to the engager, the gutter does not twist, but instead the entire gutter readily rotates. Furthermore, because the force is applied directly to the gutter via the engager, a simplified bracket system may be employed with this simple gutter.

Because the gutter is torsionally stabilized, it will now be possible to spring load the gutter such that it automatically returns to an upright position when released. This may be accomplished with the use of springs, elastics or some other retracting means attached to the gutter and the house (or bracket). Preferably, multiple springs will be placed along the length of the gutter and the strength of the spring will be calibrated to allow easy return of the gutter without hindering the initial rotation thereby. The placement of the spring can be determined empirically. Of course, this embodiment is somewhat more complicated than the basic invention and is optional.

The gutter may be formed of single large sections designed to be cut to size on location or may be made of smaller units designed to fit together end to end. The units may terminate with one end being of smaller diameter and designed to fit inside the opposite end of an adjacent unit. These joints may then be sealed with the appropriate adhesive or fasteners if desired. Alternatively, the ends may be loosely fitted and the entire gutter mounted at a slight angle so that water flows towards each smaller diameter end and ultimately towards the downspout. Thus, the sections can be independently rotated while minimizing leakage.

Alternatively, two sections may simply abut each other inside an annular clamp. The clamp may be made of the same material as the gutter and may be either an arcuate portion of a hollow cylinder or a complete hollow cylinder (annulus). O-rings may be placed between the sections and the clamp to seal the gutter or the section ends and clamp may be adhered together. In yet another alternative, the sections may include a flange at the ends, two of which may be joined with fasteners or adhesives.

In yet another alternative, a joint is provided that holds two sections in abutment, yet allows each section to be independently rotated. In one variation of a joint, the joint is annular and has a lip. When combined with sections that are flanged on each end, the lip functions to hold the flanges in abutment. Thus the joint encircles the abutted ends and holds them closely, yet not so tightly as to prevent independent rotation.

Of course, the gutter bracket assembly can be provided with down spout and comer units by employing the skills well known in the art. However, it may be preferred to fit the gutter inside a down spout or comer unit that is of sufficiently large diameter to allow the gutter to rotate freely therein without disassembling the downspout or corner unit. A screen may also be provided to cap the gutter. A small screen-cap designed to fit inside the end of the gutter may be appropriate as it will not interfere with the free rotation of the gutter, yet prevent debris from flowing into the downspout or corner unit. The screen-cap may be integral to the gutter or be provided as a separate component.

The bracket invented to support the gutter is simplified over prior art bracket systems. The bracket has an arcuate portion adapted to receive the gutter and a second mounting portion that functions to mount the bracket on a building. Herein, this mounting portion is described as an attachment portion, and a wide variety of possible shapes are indicated by the figures. The arcuate portion should be of sufficient arc to fully hold the gutter throughout its rotation and may comprise a full 360° arc. However, an arc of anywhere between 180° to 360° should suffice to firmly hold the gutter when fitted into the arcuate portion of the bracket.

The tightness of the fit of the arcuate portion of the bracket determines how easily the gutter will turn inside the bracket. It is possible to equip the bracket with an adjusting screw, or similar device, to vary the tightness of the fit. The adjuster will be used to increase the diameter of the arcuate portion of the bracket, thus decreasing the tightness of the fit and facilitating the rotation of the gutter therein.

The arcuate portion of the bracket may have a slot therein adapted to receive the engager of the gutter when assembled therewith. The engager-in-slot embodiment provides for increased stability of the system, but is not a required feature. Another method of increasing the stability of the system is to position the bracket over the stabilizer ring when assembled with the gutter. Thus, the gutter does not become displaced during rotation because the stabilizer rings hold the gutter securely within the arcuate portion of the bracket.

In one embodiment, the bracket may be assembled from separate parts whereby the arcuate portion is connected to the attachment portion via fasteners. In this case, it is desirable for the inner face of the arcuate portion to be provided with recesses adapted to receive the fasteners in order that the fasteners not protrude into the space provided for the gutter. Separate arcuate portions and attachment portions allow the attachment portion to be made of metal, thus increasing its durability and strength. Yet the arcuate portion may be comprised of the same material as the gutter, improving its aesthetics. Separate components also allow for easy assembly of the system.

Alternatively, the bracket may be integrally formed of a thermoplastic material which may be the same as the material used to form the gutter for improved aesthetics. In this case, it may be desirable to reinforce the attachment portion of the bracket with stiffening ribs or by increasing its thickness. Thus, the attachment to the building will be fully secure and durable.

When the bracket and the gutter are integrally formed and a engager-in-slot embodiment is desired, it is necessary to provide both the attachment and arcuate portions of the bracket with a gap. Flexibility in the material from which the bracket is formed will allow pressure to be employed to spread these gaps sufficiently wide so as to allow the gutter to freely pass therethrough during assembly.

When the engager-in-slot embodiment is not employed, or the engager is to be added after the gutter/racket is assembled (e.g., if the gutter is not fully integral), no gaps need be provided and the gutter may be passed through the 360° arc of the arcuate portion from its end.

A working embodiment of the gutter was made with conventional, readily available materials and is described. The trough was created by cutting a PVC pipe lengthwise to form said trough, but might also be formed from sheet metal. Stabilizer rings were left in the upper half of the pipe for increased torsional strength and for attachment of the engager. The engager was attached to a stabilizer ring by screwing an eye loop into the pipe.

The bracket was made of separate arcuate and attachment portions. The arcuate portion was formed from a section of PVC pipe. The diameter of the arcuate portion was sufficiently large to receive the gutter and provide minimal frictional resistance against rotation of the gutter. An arc of about 225° was used and was sufficient to allow easy insertion of the gutter, yet securely hold the gutter when in place. The arcuate portion of the working embodiment of the bracket was also provided with a slot adapted to receive the engager of the gutter.

The attachment portion was formed from a commercially available C-shaped bracket with holes therein for attachment to various surfaces. Fasteners attached the arcuate and attachment portions together.

Assembly proceeded as follows: first the attachment portion was mounted on a vertical surface. Then the gutter was fitted inside the arcuate portion with the engager protruding through the slot in the arcuate portion, and the two portions of the bracket were fastened together. Multiple brackets were employed and each was positioned along the gutter where a stabilizer ring was found. A long pole hook allowed the gutter to be easily rotated from a position below the gutter bracket assembly.

These and other advantages of the present invention will become apparent from the following detailed description.

BRIEF DESCRIPTION OF THE DRAWINGS

FIG. 2*c* is an end view of a bracket mounted to a roof.

FIG. 3 is a perspective view of a bracket with slot.

FIG. 4 is a cross section of a gutter and bracket assembly, cross sectioned through the slot and engager.

FIG. 5*a* is an end view of an integral bracket with gaps for allowing insertion of the gutter.

FIG. 5*b* is an end view of an integral bracket without gaps.

FIG. 6 is an end on view of an adjustable fit bracket.

FIG. 7 is an end on view of a separate stabilizer ring and trough.

FIG. 8 is a partial cross section through two abutted trough ends with an flange fitted into a joint.

DETAILED DESCRIPTION OF THE INVENTION

Figure 1:
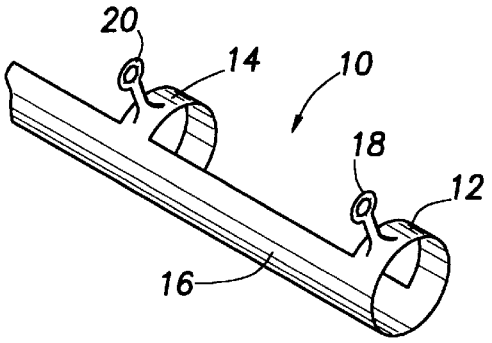
FIG. 1 is a perspective view of an integral gutter.

In FIG. 1 a perspective view of a portion of a gutter 10 is illustrated. The gutter 10 has a long, semi-cylindrical, hollow trough 16 for catching runoff. A plurality of semi-cylindrical, hollow stabilizing rings 12, 14 connected to the trough 16 at intervals are provided for increased resistance to torsional strain. On the stabilizer rings 12, 14 are found one or more protrusions, called engagers 18, 20. An engager 18, 20 can be caught by a long pole hook and used to rotate the gutter 10 about the horizontal axis centered in the stabilizing ring/trough cylinder.

Figure 2A:
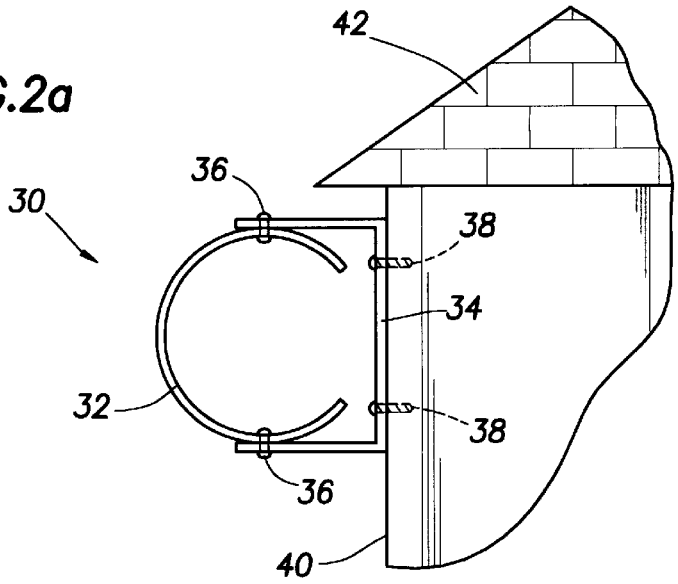
FIG. 2*a* is an end view of a bracket mounted to the fascia of a building.
Figure 2B:
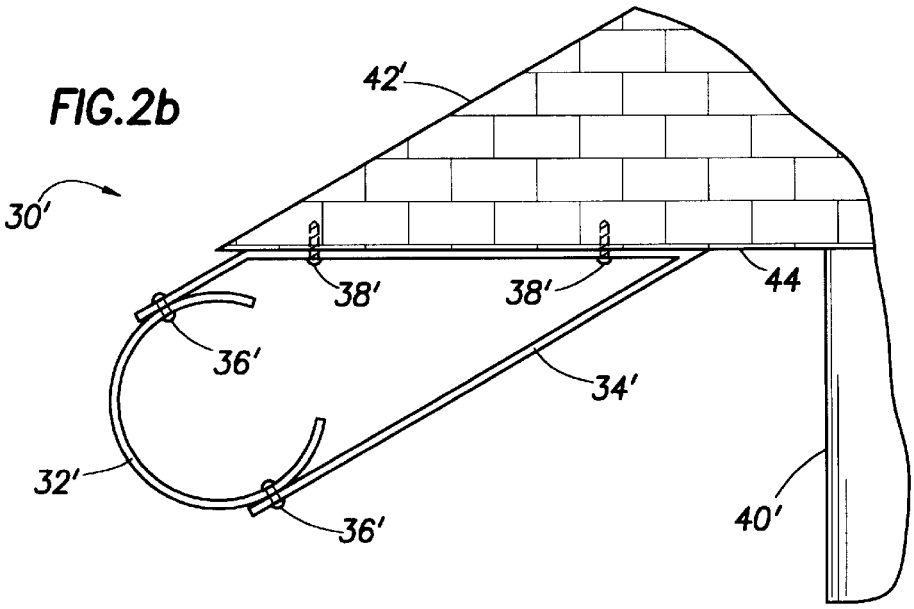
FIG. 2*b* is an end view of a bracket mounted to the horizontal underhang of a roof.

FIGS. 2*a*, 2*b* and 2*c* are end views of various bracket embodiments. FIG. 2*a* depicts a basic bracket 30 for use with the gutter. An arcuate portion 32, made from plastic pipe for example, functions to hold the rain gutter 10 (not shown). The arcuate portion 32 must be of interior diameter slightly larger than the outer diameter of the trough 16 of the gutter 10 to allow for easy rotation of the gutter 10 within the arcuate portion 32. The arcuate portion 32 is attached to a house via an attachment portion 34 as shown.

In one embodiment, the attachment portion 34 may be a readily available C-shaped metal bracket with regularly spaced holes for attachment purposes. The attachment portion 34 is attached to the arcuate portion 32 via a pair of fasteners 36, which may be rivets, bolts, screws, pins and the like. In a preferred embodiment, a small recess (not shown) is provided on the inside of the arcuate portion 32 to receive the end of a fastener 36 so that the fastener does not protrude into the space provided for the gutter and thus impede the free rotation of the gutter 10 (not shown).

The attachment portion 34 is affixed to the fascia 40 of the house via house fasteners 38, which may be nails, screws, rivets and the like. For simplicity, only a pair of fasteners 36 and house fasteners 38 are depicted, but the number of either fastener type is of course variable.

FIGS. 2*b* and 2*c* show the bracket modified to fit different roof styles. The reference labels are indicated as prime (FIG. 2*b*) and double prime (FIG. 2*c*) to show correspondence with like structures in FIG. 2*a*. FIG. 2*b* shows a bracket 30' adapted to attach to the horizontal underhang 44 of a roof 42', whereas FIG. 2*c* shows a bracket 30" attached to the slanted undersurface of a roof 42". In all cases the bracket has an attachment portion 34, 34', 34", the angles (or curves) of which may be adjusted to accommodate various planes of attachment, as indicated, while holding the gutter 10 (not shown) in the appropriate location under the lip of the roof. Arcuate portions 32, 32', 32" may remain unchanged.

FIG. 3 is a perspective view of a bracket with a slot to receive the engager of a gutter when assembled therewith. The bracket 50 has an arcuate portion 52 and an attachment portion 54 held together with fasteners 56. The bracket 50 is mounted to a vertical surface of a house (not shown) with house fasteners 58. The arcuate portion 52 has a slot 60 therein adapted to receive an engager of a gutter when assembled therewith as shown in FIG. 4.

FIG. 4 is a cross section of a bracket and gutter assembly. The bracket is sectioned through the slot (as indicated in FIG. 3) and the gutter is sectioned through a stabilizer ring and engager. The bracket is assembled with the gutter such that the engager protrudes through said slot. The bracket and gutter assembly 70 is comprised of a gutter 72 and a bracket 80. The gutter 72 has a trough 74 and a stabilizer ring 76 connected to the trough 74 with an engager 78 protruding from the stabilizer ring 76.

Fitting the engager 78 through the slot 90 provides increased stability of the bracket and gutter assembly 70, but is not required. The engager can easily fit on a stabilizer brackets, brackets, leaving a stabilizer ring without an engager to fit inside the bracket. Fitting the bracket over a stabilizer ring, with or without engager, provides increased stability and is thus preferred.

The bracket 80 consists of an arcuate portion 82 connected to an attachment portion 84 by means of fasteners 86. The attachment portion 84 is mounted to a house with house fasteners 88. The arcuate portion 82 of bracket 80 has a slot 90 therein, adapted to receive the engager 78. The engager 78 fits through the slot 90 and can be activated (see heavy black arrow) to rotate the gutter 72 about its central axis.

FIG. 5*a* and 5*b* show end views of other preferred embodiments of brackets. The reference numerals in FIG. 5*b* are indicated as prime to show correspondence with like numerals in FIG. 5*a*. Integral bracket 100, 100' is integrally formed from a suitable material, thus eliminating the need for fastening the arcuate portion 102, 102' to the attachment portion 104, 104'. If the engager of an integral gutter is to be fitted through a slot in the arcuate portion 102, then a gap 108 in the arcuate portion 102 and a gap 106 in the attachment portion 104 is provided to allow the two ends of the bracket to be spread apart (see heavy black arrows) to allow the gutter to pass through the gaps and fit into the arcuate portion 102 of said integral bracket 100.

Of course, if the engager is to be added after the gutter and bracket are assembled, then no such gap is required (as shown in FIG. 5*b*), as the gutter can slip into the bracket endwise. Alternatively, the engager need not pass through a slot in a bracket, but may be situated on a stabilizer ring between brackets. In this case as well, no gaps are required in the bracket.

FIG. 6 is a side view of a bracket with a screw included for adjustment of the size of the arcuate portion in order to control the tightness of the fit around the trough. Yet another embodiment of the attachment portion 114 with fasteners 116 of the bracket 110 is shown in this figure. Adjustor 118 (in this case a screw and bolt) is shown on the attachment portion 114 which serves to control the diameter of the arcuate portion 112.

If the degree of adjustment is small, the bracket 110 may accommodate the change by deforming slightly. However, if the degree of adjustment is large, the bracket 110 may be provided with slightly elongated holes (not shown) through which the fasteners 116 fit. Thus, the elongated holes allow the attachment portion 114 to be compressed or spread slightly while attached to the building to accommodate the adjustment of the arcuate portion 112. More complicated means of allowing the adjustment to be made are of course possible (for example a sliding portion fitted into a track that is attached to the house) and within the scope of the art.

FIG. 7 is an end on view of a gutter 120 where the stabilizer ring 122 and trough 124 are not integral. A protrusion 126 from the inner surface of the stabilizer ring 122 is shaped to receive the trough 124, thus securing the ring 122 and the trough 124. Alternatively, the trough 124 can be attached to the stabilizer ring 122 by adhesives, fasteners or frictional means.

FIG. 8 is a partial cross-section of two abutting gutter sections 130. The abutting trough 132 ends in a flange 136 which abuts against an adjacent flange 136. The ends are held with an annular joint 134 which allows the abutting troughs 132 to rotate freely, yet keeps them closely abutted.

Many other variations and modifications may be made in the devices herein described, by those having experience in this art, without departing from the concept of the present invention. Accordingly, it should be clearly understood that the devices described above are illustrative only, and not intended as a limitation on the scope of the invention.

What is claimed is:

1. A rotating rain gutter, comprising;

(1) a trough for catching building runoff;

(2) a plurality of stabilizing rings connected to said trough at intervals for increased resistance to torsional strain;

(3) an engager on at least one of said plurality of stabilizing rings for rotating the gutter;

(4) a bracket comprising (a) an arcuate portion;

(b) an attachment portion coupled to said arcuate portion; and (c) house fasteners for fastening said attachment portion to a building; and (5) an adjuster for adjusting the fit of said arcuate portion around said trough.

2. A rotating rain gutter as in claim 1, wherein the gutter comprises a thermoplastic material.

3. A rotating rain gutter as in claim 1, wherein the gutter comprises metal.

4. A rotating gutter and bracket assembly, comprising:

(1) a gutter having, (a) a trough for catching building runoff;

(b) a plurality of stabilizing rings connected to said trough at intervals for increased resistance to torsional strain; and (c) an engager on at least one of said plurality of stabilizing rings used to rotate the gutter;

(2) a bracket having, (a) an arcuate portion;

(b) an attachment portion coupled to said arcuate portion; and (c) house fasteners for fastening said attachment portion to a building, wherein when the gutter and bracket are assembled, said gutter is fitted within said arcuate portion of said bracket; and (3) an adjuster for adjusting the fit of said arcuate portion around said trough.

5. A gutter and bracket assembly as in claim 4, wherein each of said stabilizing rings has an uppermost point and wherein said engager is positioned on at least one of said stabilizing rings between 0 and 45 degrees from the uppermost point of the stabilizing ring.

6. A gutter and bracket assembly as in claim 4, wherein said bracket comprises metal.

7. A gutter and bracket assembly as in claim. 4, wherein said stabilizing rings and said trough are formed as separate parts.

8. A gutter and bracket assembly as in claim 7, wherein said stabilizing rings are provided with at least one protrusion on their respective inner surfaces to frictionally hold said trough.

9. A gutter and bracket assembly as in claim 4, wherein said bracket is integrally formed of a thermoplastic material and said gutter comprises a thermoplastic material.

10. A gutter and bracket assembly as in claim 9, wherein said arcuate portion further comprises a slot therein adapted to receive said engager of said gutter when assembled therewith.

11. A gutter and bracket assembly as in claim 10, wherein said attachment portion and arcuate portion each have a gap to allow the gutter to pass through during assembly.

12. A gutter and bracket assembly as in claim 10, wherein said arcuate portion is a circle.

13. A gutter and bracket assembly as in claim 10, wherein said bracket is positioned over said stabilizing rings when assembled with said gutter.

14. A gutter and bracket assembly as in claim 4, wherein said arcuate portion is connected to said attachment portion via fasteners.

15. A gutter and bracket assembly as in claim 14, wherein said arcuate portion comprises an inner face with recesses adapted to fit said fasteners.

16. A gutter and bracket assembly as in claim 14, wherein said arcuate portion further comprises a slot therein adapted to receive said engager of said gutter when assembled therewith.

17. A gutter and bracket assembly as in claim 14, wherein said bracket is positioned over said stabilizing rings when assembled with said gutter.

* * * * *